US005242153A

United States Patent [19]

Stuart

[11] Patent Number: 5,242,153

[45] Date of Patent: Sep. 7, 1993

[54] DUAL-TIRE FOREIGN-OBJECT REMOVING APPARATUS

[76] Inventor: Robert B. Stuart, 6805 Hillcrest Rd., Medford, Oreg. 97504

[21] Appl. No.: 919,765

[22] Filed: Jul. 24, 1992

[51] Int. Cl.[5] ..... B66F 3/00

[52] U.S. Cl. ..... 254/131

[58] Field of Search ..... 254/120, 131, 133, 127, 254/47, 4 R, 4 B, 4 C, 264; 294/31.2, 74; 81/64

[56] References Cited

U.S. PATENT DOCUMENTS 1,353,365 9/1920 Webb et al. .
1,509,994 9/1924 Carroll .
1,915,682 6/1933 Maeda .
3,416,763 12/1968 Moreno .
3,964,729 6/1976 Harlow ..... 254/131
4,079,642 3/1978 Scott ..... 81/64
4,222,550 9/1980 de Bosredon .
4,250,769 2/1981 Herring .
4,529,170 7/1985 Whitt et al. ..... 254/131
4,913,010 4/1990 Doss ..... 81/64
4,978,103 12/1990 Moisan ..... 254/131

*Primary Examiner*—Robert C. Watson
*Attorney, Agent, or Firm*—Kolisch, Hartwell, Dickinson, McCormack & Heuser

[57] ABSTRACT

A dual-tire foreign-object removing apparatus includes a web which is trainable about a foreign object lodged between dual vehicle tires, a rod for applying a pulling force to the web and the foreign object and a reaction element which provides a stand-off from the tires for the rod.

10 Claims, 2 Drawing Sheets

DUAL-TIRE FOREIGN-OBJECT REMOVING APPARATUS

BACKGROUND AND SUMMARY OF THE INVENTION

This invention relates to truck safety equipment and specifically to an apparatus which is useful to remove foreign objects, such as rocks, which may become lodged between dual tires on trucks.

One of the most frequently encountered hazards with large trucks is the lodging of a rock or other foreign object between dual tires on the truck or trailer. This situation generally arises when a truck operates off of paved surfaces and has an opportunity to pick up rocks or foreign objects between the dual tires found on most large vehicles. Such an object will generally remain lodged between the tires while the truck is operating at low speed and will be dislodged by centrifugal force once the truck accelerates to a higher speed, as when the truck begins operating on paved surfaces. The dislodged object may become a hazardous projectile if the object is dislodged at high speed, wherein the object may be thrown rearward, or possibly forward, from the truck into the path of trailing, or oncoming, traffic.

Known techniques and devices for removing such objects include the insertion of a lever between the dual tires, which may be used to dislodge the object. However, in the case where the tires are located under a truck body or trailer body, the amount of leverage and the angles at which the leverage must be applied may be insufficient to remove the object from between the tires.

Another technique known for dislodging such an object when the object is lodged between the tires of a dump-type truck is to raise the truck bed, secure a chain to the bed behind the tilting point, train the chain about the object, secure the chain, and lower the bed. This is an effective way of removing the object, although, if the bed is loaded, there may not be enough tilting available to remove an object in a single try, and will then require multiple attempts to remove the object. Such procedures are very unsafe.

An object of the invention is to provide an apparatus which is readily available to remove a foreign object lodged between dual tires of a truck.

Another object of the invention is to provide such an apparatus which is lightweight, compact, inexpensive to manufacture and easy to use.

A further object of the invention is to provide such an apparatus which will enable removal of a foreign object in a safe and efficient manner.

The apparatus of the invention includes a web which is trainable about a foreign object lodged between dual tires, a rod for applying a pulling force to the foreign object and a reaction element which provides a stand off for the rod from the tires.

These and other objects and advantages of the invention will become more fully apparent as the description which follows is read in connection with the drawings.

DETAILED DESCRIPTION OF THE PREFERRED EMBODIMENT

Figure 1:
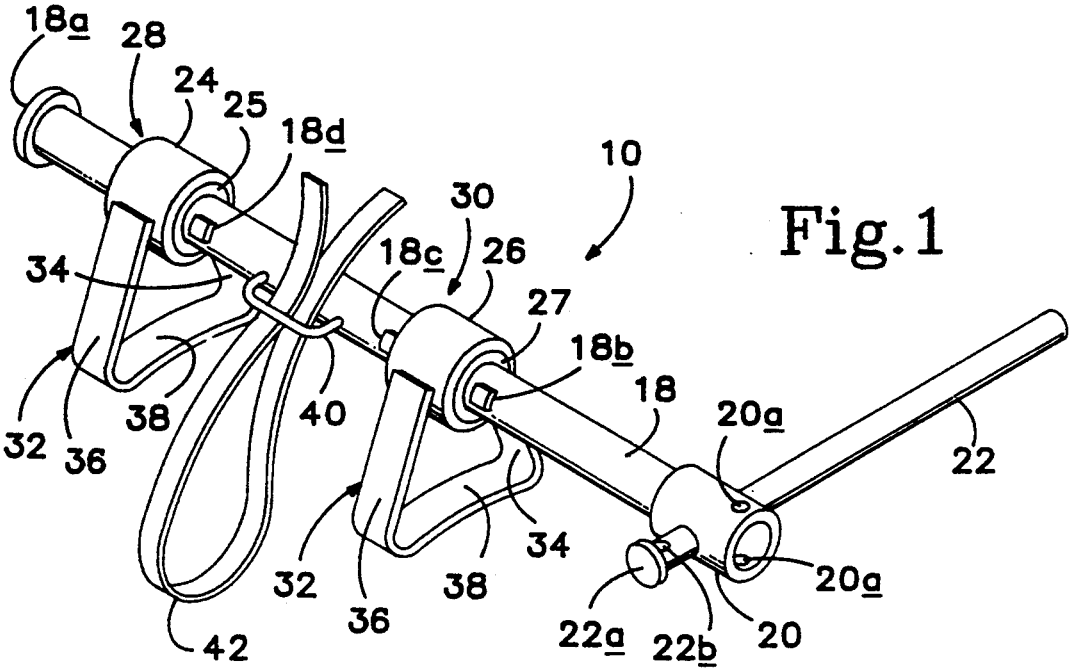
FIG. 1 is a perspective view of a dual-tire foreign-object removing apparatus constructed according to the invention.
Figure 2:
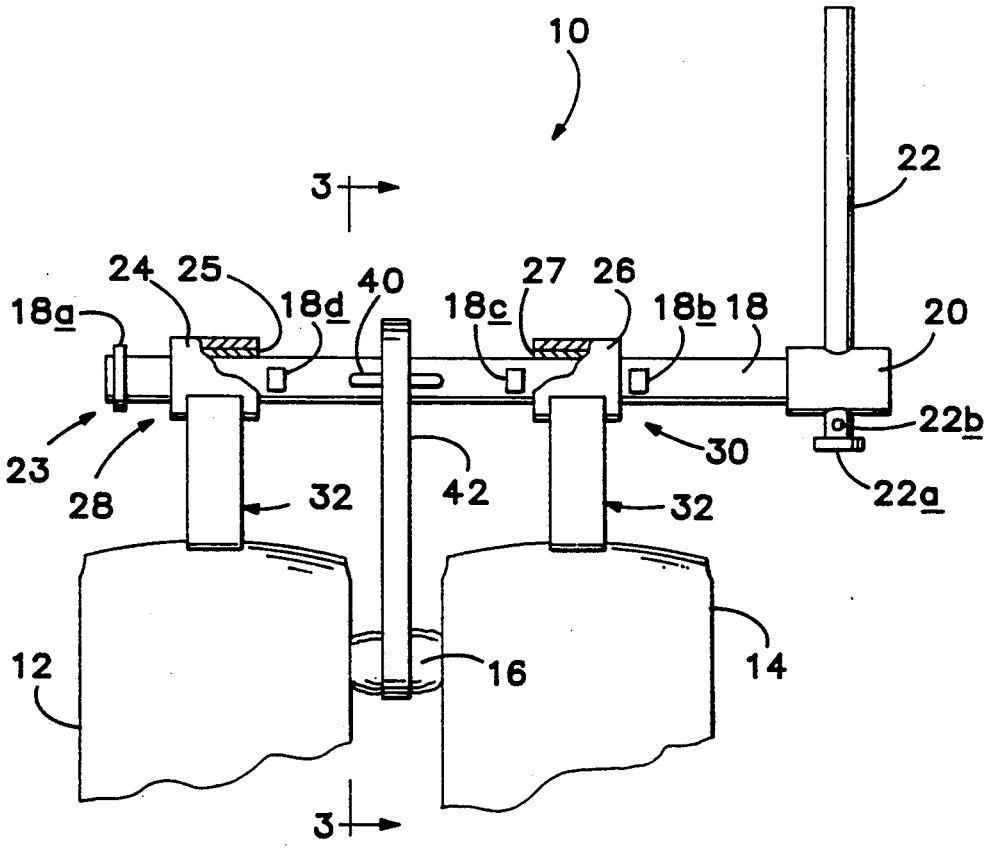
FIG. 2 is a front elevation of the apparatus in an environmental setting.
Figure 3:
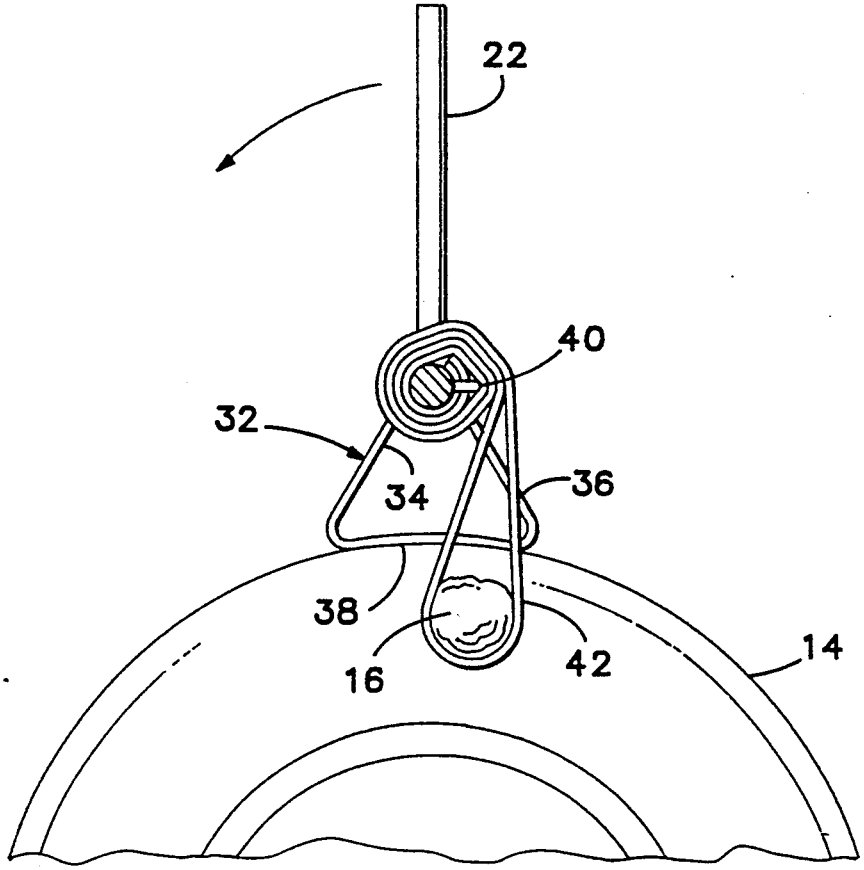
FIG. 3 is a side elevation of the apparatus in an environmental setting.

Referring now to the drawings, and initially to FIGS. 1-3, a dual-tire foreign-object removing apparatus constructed according to the invention is shown generally at 10. Apparatus 10 is intended for use on vehicles having dual tires, as depicted at 12 and 14. (FIG. 2) A rock 16, also referred to herein as a foreign object, is depicted in a lodged condition between tires 12 and 14. As previously noted, such condition presents a serious hazard should the vehicle begin operating at high speed with rock 16 lodged between the tires. Apparatus 10 is operable to provide an easy and efficient mechanism for removing the rock.

Apparatus 10, in the preferred embodiment includes a rod or shaft 18 which has a lever receptacle 20 located at one end thereof. A lever 22 is provided to operate apparatus 10. Lever 22 has a stop **22*a* fixed to one end thereof to prevent lever 22 from slipping completely through lever receptacle 20. A stop 18*a* is attached, as by welding, to the other end of shaft 18. Bores 20*a* in receptacle 20 and bore 22*a* in lever 22** are provided for facilitating storage, which will be explained in more detail later herein.

Rod 18 is carried in reaction means 23 which provides a means for rod 18 to react against tires 12, 14.

In the first embodiment, rod 18 is received in bearing mounts 24, 26, having bearings 25, 27 therein, which form parts of reaction elements 28, 30 respectively. In this embodiment, reaction elements 28, 30 comprise reaction means 23. Bearing mounts 24, 26 are maintained in place on rod 18 by positioners, such as **18*b*, 18*c* and 18*d*. The positioners may be formed from small pieces of metal which are welded to rod 18**.

The reaction element includes a substantially triangular frame 32, having equal length sides 34, 36, and a curved base 38, which is intended substantially to conform to the curvature of a truck tire. Frame 32 is positioned on a tire to provide a stand off for rod 18 to increase the distance between rod 18 and rock 16.

Rod 18, also referred to herein as tensioning means, includes a bail 40 which, in the preferred embodiment, is affixed to the rod as by welding, and is formed of a steel cylindrical section having a diameter of approximately one-quarter inch. Bail 40 acts as a receptacle or receiver for a web 42 which is trainable about rock 16.

In the preferred embodiment, web 42 is a nylon strap having a width of approximately two inches and a length of five feet. The web is selected to have a breaking force of approximately 10,000 pounds. Web 42 is also referred to herein as foreign-object gripping means. A chain cable or other elongate flexible object means also functions as an foreign-object gripping means.

In operation, once a vehicle operator discovers that a rock is lodged between dual tires of the vehicles, the vehicle is stopped such that the rock is in an above-center position relative to the axle carrying the wheels and tires. Apparatus 10 is positioned on the tires with reaction elements 28 and 30 in contact with the tires and lever 22 positioned in lever receptacle 20.

Strap 42 is trained about rock 16 and the two ends of the web pass through bail 40. Shaft 18 is rotated to take up slack, which also captures web 42 about shaft 18, thereby transmitting a force from rod 18 to rock 16. Lever 22 is rotated, thereby rotating rod 18 and applying further tension to strap 42 until rock 16 is dislodged from between the tires.

Once the rock is dislodged, lever 22 may be removed from lever receptacle 20 and stored within the hollow interior of rod 18, thus providing a compact storage package for the apparatus. A clip (not shown) may be inserted through bores 20*a* and 22*b* to retain lever 22 within rod 18.

Figure 4:
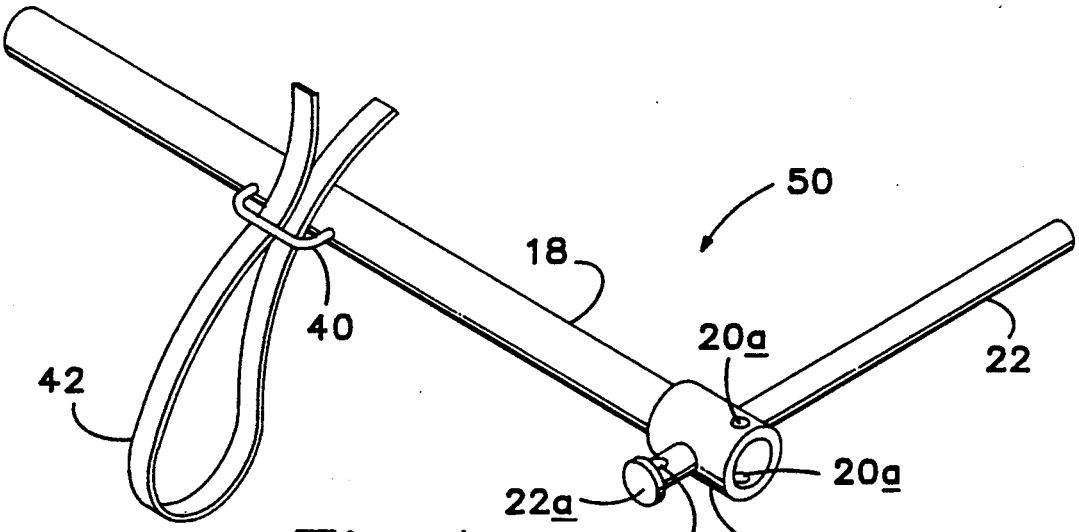
FIG. 4 is a perspective view of an alternate embodiment of the invention.

Referring now to FIG. 4, a modified form of the apparatus is depicted at 50. In this embodiment, reaction elements 28 and 30 are eliminated. This allows for an even more compact apparatus. In such an embodiment, rod 18 serves as both tensioning means and reaction means, as it is placed directly against the truck tires and is rotated thereon. Such an embodiment is appropriate for vehicles with smaller size dual tires, where the spacing between the tires is not as great and the size of foreign objects which may be picked up is therefore, also not as great. Such an embodiment may be appropriate for vehicles such as motor homes and dual-tire pickup trucks.

Although a preferred embodiment of the invention and a modified form thereof have been disclosed herein, it should be appreciated that further modifications may be made thereto without departing from the scope of the invention as defined in the appended claims.

What I claim is:

1. A dual-tire foreign-object removing apparatus comprising:

foreign-object gripping means for gripping a foreign object lodged between dual tires;

tensioning means for applying a pulling force to the foreign object, including a shaft having a receiver, including a bail, for said foreign-object gripping means, wherein said foreign-object gripping means is wrapped about said shaft and through said bail; and reaction means for reacting with a tire.

2. The dual-tire foreign-object removing apparatus of claim 1 wherein said reaction means includes a reaction element which provides a standoff for said tensioning means from the tires.

3. The dual-tire foreign-object removing apparatus of claim 2 wherein said reaction element includes a substantially triangular frame, wherein said triangular frame is constructed and arranged such that the base of said triangular frame is supported by a tire when the apparatus is in use, and the side of said triangular frame are directed outwardly from the axle supporting the tire.

4. The dual-tire foreign-object removing apparatus of claim 3 wherein said reaction element includes a bearing mounted on said frame for rotatably receiving said tensioning means.

5. The dual-tire foreign-object removing apparatus of claim 1 wherein said gripping means includes an elongate web which is trainable about the foreign object.

6. The dual-tire foreign-object removing apparatus of claim 1 which includes a shaft having a lever thereon, wherein said shaft includes said tensioning means and said reaction means.

7. A dual-tire foreign-object removing apparatus comprising:

foreign-object gripping web which is trainable about a foreign object lodged between dual tires;

a rod for applying a pulling force to the foreign object, including a bail which is affixed to said rod for receiving said web therein, a lever receptacle located adjacent an end of said rod, and a lever receivable in said lever receptacle for rotating said rod; and reaction means for reacting with a tire.

8. The dual-tire foreign-object removing apparatus of claim 7 wherein said reaction means includes a reaction element which provides a standoff for said rod from the tires, wherein said standoff includes a substantially triangular frame having a base, which is constructed and arranged to engage a tire, and two substantially equal height sides extending from said base.

9. The dual-tire foreign-object removing apparatus of claim 8 wherein said frame includes a bearing thereon for rotatably receiving said rod.

10. A dual-tire foreign-object removing apparatus comprising:

foreign-object gripping web which is trainable about a foreign object lodged between dual tires;

a rod for applying a pulling force to the foreign object, said rod having a bail located thereon for capturing said web thereby; and a reaction element which provides a standoff for said rod from the tires having a substantially triangular frame and a bearing thereon for rotatably receiving said rod, said triangular frame having a base which is curved to be substantially conformal with a tire and to rest thereon during use of the apparatus, and which further includes a pair of sides extending from said base, wherein said bearing is located at the apex of said triangular frame.

* * * * *